US006334298B1

(12) United States Patent
Aicholtz

(10) Patent No.: US 6,334,298 B1
(45) Date of Patent: Jan. 1, 2002

(54) GAS TURBINE COMBUSTOR HAVING DOME-TO-LINER JOINT

(75) Inventor: John Charles Aicholtz, Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 12 days.

(21) Appl. No.: 09/616,258

(22) Filed: Jul. 14, 2000

(51) Int. Cl.[7] ..... F02C 7/20
(52) U.S. Cl. ..... 60/39.31; 60/750
(58) Field of Search ..... 60/750, 752, 39.31, 60/39.32

(56) References Cited

U.S. PATENT DOCUMENTS 3,965,066 A * 6/1976 Sterman ..... 60/39.32
5,533,330 A * 7/1996 Mullooly ..... 60/39.32
6,286,298 * 9/2001 Burrus ..... 60/39.06
6,286,317 * 9/2001 Burrus ..... 60/752

* cited by examiner

*Primary Examiner*—Charles G. Freay
*Assistant Examiner*—Ehud Gartenberg
(74) *Attorney, Agent, or Firm*—Andrew C. Hess; Rodney M. Young

(57) ABSTRACT

A joint for joining a dome plate to a combustor liner includes a first flange formed on the dome plate and a second flange formed on the liner. A mounting ring having a groove formed therein is provided such that the first flange is disposed in the groove and the second flange engages the mounting ring. A retainer is secured to the mounting ring and engages the second flange.

29 Claims, 3 Drawing Sheets

GAS TURBINE COMBUSTOR HAVING DOME-TO-LINER JOINT

STATEMENT REGARDING FEDERALLY SPONSORED RESEARCH & DEVELOPMENT

The U.S. Government may have certain rights in this invention pursuant to contract number F33615-97-C-2778 awarded by the Department of the Air Force.

BACKGROUND OF THE INVENTION

This invention relates generally to combustors for gas turbine engines and more particularly to joints that connect a combustor dome plate to the combustor liners.

A gas turbine engine includes a compressor that provides pressurized air to a combustor wherein the air is mixed with fuel and ignited for generating hot combustion gases. These gases flow downstream to one or more turbines that extract energy therefrom to power the compressor and provide useful work such as powering an aircraft in flight. Combustors used in aircraft engines typically include inner and outer combustor liners to protect surrounding engine structure from the intense heat generated by the combustion process. The combustor liners are cooled to meet life expectancy requirements by diverting a portion of the compressed air and causing it to flow over the surfaces of the liners.

Advanced aircraft gas turbine engine technology is driving combustors to be shorter in length, have higher performance levels over wider operating ranges, and produce lower emission levels. To achieve these goals, the so-called trapped vortex combustor has been proposed. A trapped vortex combustor has a non-linear cavity section located immediately downstream of an inlet dome. Fuel and air injected into the cavity, which is substantially rectangular in cross-section, form a trapped vortex for igniting and stabilizing a flame in the combustor. This arrangement has shown robust operability including stable burning over a range of fuel/air ratios, high performance, low emissions and high efficiency at very high fuel/air ratios.

A trapped vortex combustor generally includes a flat dome plate that is joined to the outer and inner liners. This typically results in some dome-to-liner joint structure being located forward of the dome plate. A number of radial fuel injectors are located upstream of the dome plate. The radial fuel injectors are preferably located parallel to and in close proximity with the dome plate so as to avoid auto-ignition of the fuel prior to reaching the combustion zone. This leaves little room for dome-to-liner joints, particularly at the outer liner. In addition, a lack of streamlining at the external comer of the dome-to-liner joint can cause an undesirable pressure loss in the air diverted from the combustor for cooling purposes. This can decrease the cooling efficiency to the combustor liners as well as turbine components.

One approach to alleviating interference between the dome-to-liner joints and the fuel injectors would be to scallop the liners to fit around the fuel injectors. However, because of the large number of radial fuel injectors usually employed, the mechanical integrity of the liners would be at risk. Sealing between the liners and the dome plate would also be very difficult. Another possible approach would be to form each fuel injector with a bend so that the fuel injectors would fit around the joints. A drawback to this approach is that assembly of the combustor would become more complicated. Each fuel injector would be first slid radially inward forward of the dome plate and then slid axially aft to engage the dome plate. This installation method would require longer holes in the case enclosing the combustor liners. Longer holes would weaken the case and create more opportunity to undesirably leak air. Furthermore, the overall length of the engine would be increased to accommodate the sliding installation of the fuel injectors.

Accordingly, there is a need for a streamlined dome-to-liner joint that has no structure forward of the dome plate.

BRIEF SUMMARY OF THE INVENTION

The above-mentioned need is met by the present invention, which provides a joint for joining a dome plate to a combustor liner. The joint includes a first flange formed on the dome plate and a second flange formed on the liner. A mounting ring having a groove formed therein is provided such that the first flange is disposed in the groove and the second flange engages the mounting ring. A retainer is secured to the mounting ring and engages the second flange.

The present invention and its advantages over the prior art will become apparent upon reading the following detailed description and the appended claims with reference to the accompanying drawings.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
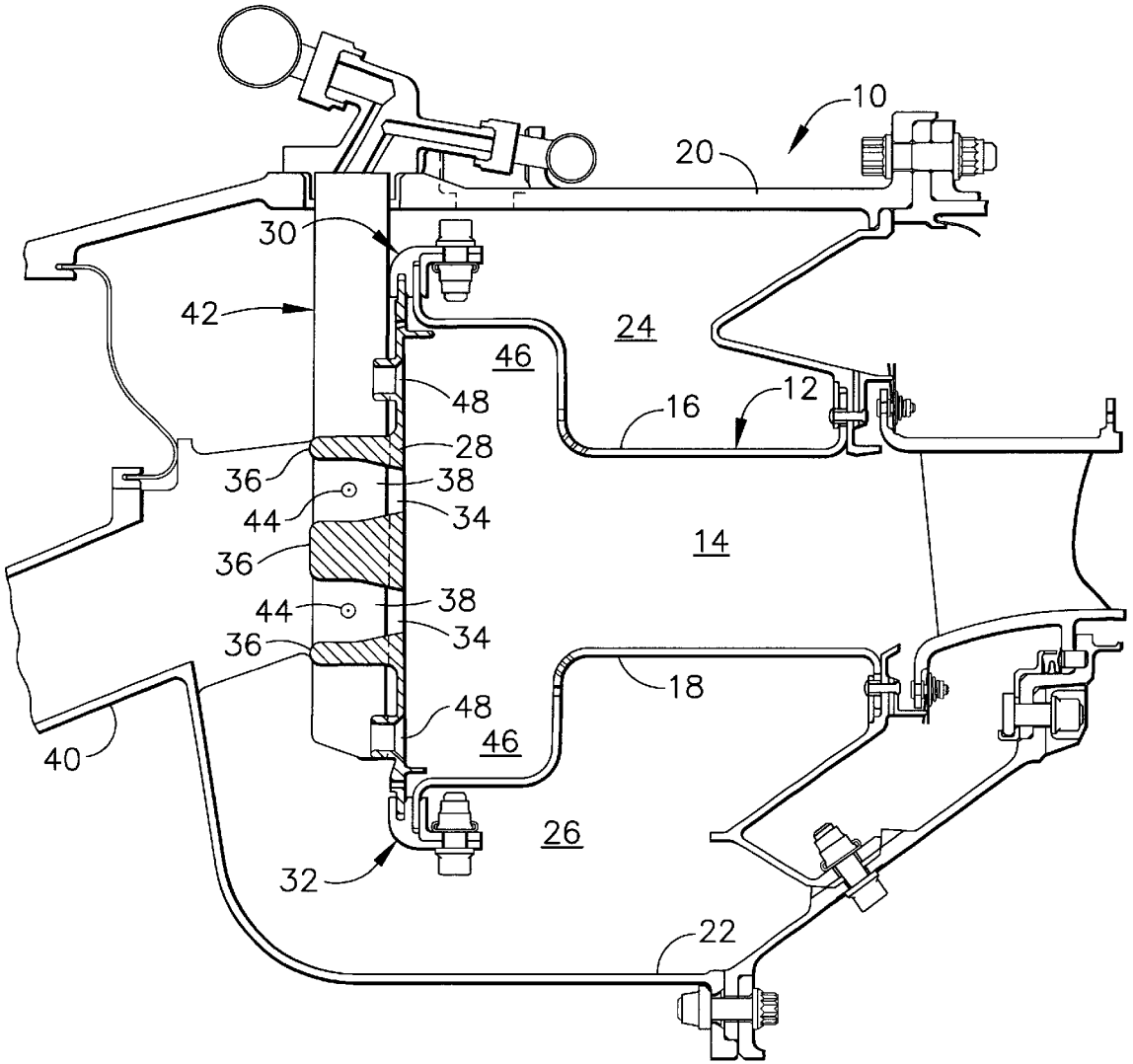
FIG. 1 is a longitudinal cross-sectional view of a trapped vortex combustor having dome-to-liner joints.

Referring to the drawings wherein identical reference numerals denote the same elements throughout the various views, FIG. 1 shows a trapped vortex combustor 10 for use in a gas turbine engine. The combustor 10 includes a hollow body 12 defining a combustion chamber 14 therein. The hollow body 12 is generally annular in form about the engine centerline axis and includes an outer liner 16 and an inner liner 18 disposed between an outer combustor casing 20 and an inner combustor casing 22. The outer liner 16 and the outer casing 20 form an outer passage 24 therebetween, and the inner liner 18 and the inner casing 22 form an inner passage 26 therebetween. The outer and inner liners 16 and 18 can be made of metal, ceramic matrix composite or any other suitable material.

The upstream end of the hollow body 12 is substantially closed off by a generally flat, annular dome plate 28 attached to the outer liner 16 by an outer dome-to-liner joint 30 and to the inner liner 18 by an inner dome-to-liner joint 32. The dome plate 28, which is preferably but not necessarily segmented to alleviate thermal stress, lies in a plane that is substantially perpendicular to the core flow streamline through the combustor 10. A number of openings 34 is formed in the dome plate 28 to provide ingress for fuel and compressed air into the combustion chamber 14. Forward extending baffles 36 are formed on the forward surface of the dome plate 28, adjacent to the openings 34. The baffles 36 define inlet passages 38 that are aligned with the openings 34.

As is known in the art, compressed air is supplied from a compressor (not shown) via a diffuser 40 located upstream of the combustor 10. The compressed air passes principally into the combustion chamber 14 via the inlet passages 38 and the openings 34 to support combustion and partially into the outer and inner passages 24 and 26 where it is used to cool the liners 16 and 18 and turbomachinery further downstream. A plurality of radial fuel injectors 42 (only one shown in FIG. 1) is provided upstream or forward of the dome plate 28. The fuel injectors 42 are attached at one end to the outer casing 20 and extend radially inward parallel to and in close proximity with the forward surface of the dome plate 28. Each fuel injector 42 has an atomizer 44 aligned with each of the inlet passages 38. Thus, fuel from a fuel manifold (not shown) flows through the radial fuel injectors 42 and is discharged into the inlet passages 38 via the atomizers 44. The fuel mixes with the compressed air flowing through the inlet passages 38 so that a fuel/air mixture flows into the combustion chamber 14. By locating the fuel injectors 42 (and thus the atomizers 44) immediately forward of the dome plate 28, the residence time of the fuel in the inlet passages 38 is extremely short, thereby minimizing the opportunity for the fuel to auto-ignite.

The combustor 10 further includes a trapped vortex cavity 46 incorporated into the hollow body 12 immediately downstream of the dome plate 28. The trapped vortex cavity 46 is preferably substantially rectangular in cross-section and is open to the combustion chamber 14. Fuel and air are injected directly into the trapped vortex cavity 46 through secondary openings 48 that are formed in the dome plate 28 and are in fluid communication with the fuel injectors 42. The trapped vortex cavity 46 is sized and shaped such that a trapped vortex of fuel and air is produced therein from the fuel and air injected through the secondary openings 48. This trapped vortex of fuel and air is ignited as necessary by an igniter 50 mounted in the outer casing 20 and the outer liner 16 (see FIG. 2), and the combustion gases generated by the trapped vortex within the cavity 46 provide a continuous ignition and stabilization source for the primary fuel/air mixture entering the combustion chamber 14 via the dome plate openings 34. It should be noted that a trapped vortex combustor is used here for purposes of illustration, but the present invention is not necessarily limited to trapped vortex combustors.

Figure 3:
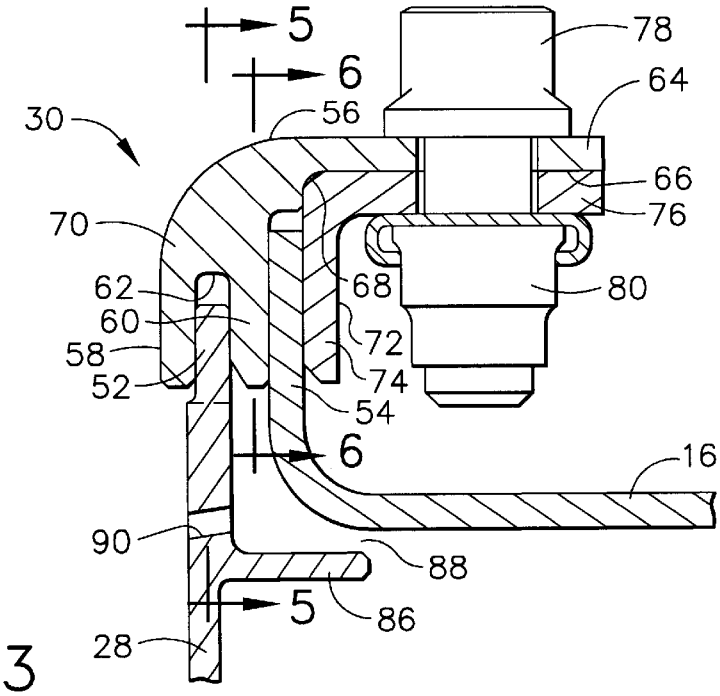
FIG. 3 is an enlarged view of a dome-to-liner joint from FIG. 1.

Referring now to FIG. 3, the outer dome-to-liner joint 30 is shown in more detail. Although FIG. 3 depicts the outer dome-to-liner joint 30, it should be understood that the inner dome-to-liner joint 32 is substantially identical structurally to the outer dome-to-liner joint 30, except that it is disposed radially inward of the inner liner 18 while the outer joint 30 is disposed radially outward of the outer liner 16. The two joints are thus oriented in opposite radial directions, but are otherwise identical to one another. As such, the following description will also apply to the inner dome-to-liner joint 32.

The dome-to-liner joint 30 comprises first and second complimentary radially extending flanges 52 and 54. The first or dome flange 52 is formed on the periphery of the dome plate 28 and extends radially outwardly therefrom. The dome flange 52 is slightly offset in the aft direction with respect to the forward surface of the dome plate 28. The second or liner flange 54 formed on the forward end of the outer liner 16 and extends radially outwardly therefrom. When the combustor 10 is properly assembled, the two flanges 52 and 54 are substantially parallel to one another.

The joint 30 further includes a mounting ring 56 that engages the dome flange 52 and the liner flange 54. As will be described in more detail below, the mounting ring 56 can be either a continuous 360 degree ring or a segmented ring comprising two, three or even more arcuate segments. The segments would form a 360 degree ring; thus, a two-segment configuration would comprise 180 degree segments, a three-segment configuration would comprise 120 degree segments, and so on. In either case, the mounting ring 56 includes a forward radial flange 58 and an aft radial flange 60 extending radially inwardly therefrom. The two flanges 58 and 60 are spaced apart axially so as to define a radial groove 62 therebetween. The dome flange 52 is disposed in the groove 62 so as to axially retain the mounting ring 56 with respect to the dome plate 28. Because of the offset of the dome flange 52, the forward radial flange 58 is nearly flush with the forward surface of the dome plate 28 when the dome flange 52 is disposed in the groove 62.

The mounting ring 56 further includes an axial flange 64 extending in an axially aft direction, and thus perpendicular to the radial flanges 58 and 60. An annular recess 66 is formed in the radially inner surface of the axial flange 64 so as to define an aft-facing abutment 68. The portion of the mounting ring 56 that joins the forward radial flange 58 and the axial flange 64 defines a convex curved surface. The mounting ring 56 thus has a rounded comer 70 on its forward, upstream-facing side. Accordingly, the joint 30 presents a streamlined external surface that minimizes pressure losses in the cooling air passing around the combustor body 12.

The mounting ring 56 is axially retained with respect to the outer liner 16 by means of a retainer 72. The retainer 72 is a segmented, 360 degree ring, which can comprise two, three or more arcuate segments. The retainer 72 is generally L-shaped in cross-section and has a radially inward extending retaining flange 74 and an axially aft extending mounting flange 76. The mounting flange 76 is received in the recess 66 of the axial flange 64 and engages the abutment 68 so as to be properly positioned with respect to the mounting ring 56. The mounting flange 76 is secured to the axial flange 64 by a plurality of bolts 78 and nuts 80 (only one of each shown in FIG. 3) or any equivalent fastening means. With the retainer 72 thus attached to the mounting ring 56, the liner flange 54 is captured between the aft side of the aft radial flange 60 and the forward side of the retaining flange 74, which extend substantially parallel to the two flanges 52 and 54. The outer liner 16 is thereby axially retained with respect to the mounting ring 56 (and thus with respect to the dome plate 28) so that the dome plate 28 and the outer liner 16 are joined together. The joint 30 is located primarily aft of the plane defined by the forward surface of the dome plate 28. Alternatively, the dome plate 28 and the dome flange 52 could be configured such that the joint 30 is located entirely aft of the plane defined by the forward surface of the dome plate 28.

Figure 4:
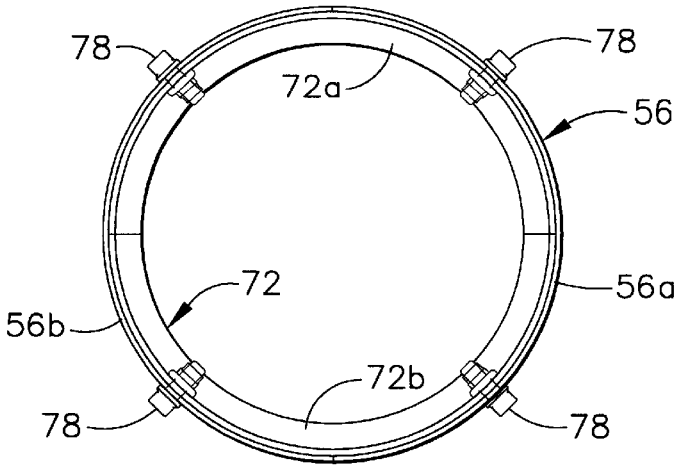
FIG. 4 is an aft-looking-forward schematic end view of the combustor of FIG. 1.

As mentioned above, the mounting ring 56 can be either a continuous or segmented 360 degree ring. In either case, the retainer 72 is segmented to permit assembly. With a segmented mounting ring 56, the arcuate segments of the mounting ring 56 are circumferentially staggered with respect to the arcuate segments of the retainer 72 so that when the mounting ring 56 and the retainer 72 are fastened together, a rigid 360 degree structure results. This is illustrated in FIG. 4 which schematically shows an aft-looking-forward view of the combustor 10 in which the mounting ring 56 comprises two 180 degree segments 56*a* and 56*b* and the retainer 72 comprises two 180 degree segments 72*a* and 72*b*. These elements are circumferentially staggered so that the first mounting ring segment 56*a* overlaps one half of each retainer segment 72*a* and 72*b*, and the second mounting ring segment 56*b* overlaps the other half of each retainer segment 72*a* and 72*b*. After being located on the dome flange 52 and the liner flange 54, the first and second mounting ring segments 56*a* are each bolted to both retainer segments 72*a* and 72*b* so as to form a rigid 360 degree structure. In this embodiment, the various flanges that comprise the joint 30 can be, but are not necessarily, coextensive with their corresponding parent structure.

Figure 5:
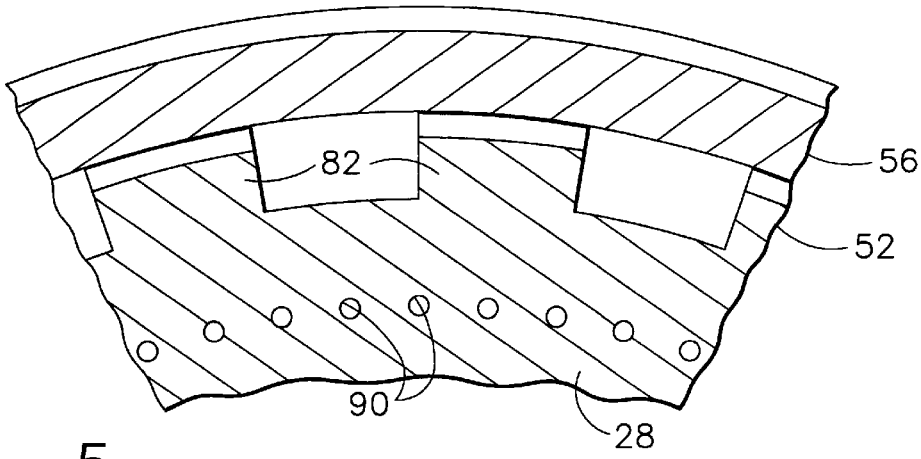
FIG. 5 is a partial sectional view of the combustor of FIG. 3 taken along line 5—5.
Figure 6:
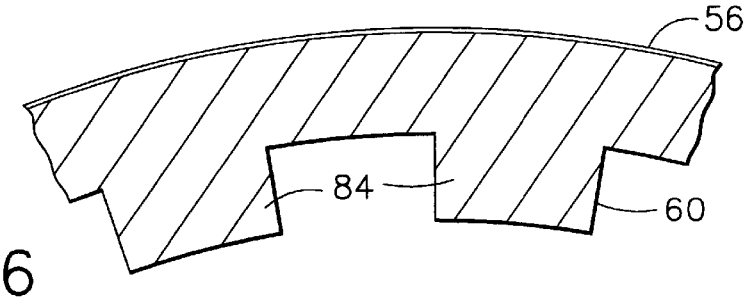
FIG. 6 is a partial sectional view of the combustor of FIG. 3 taken along line 6—6.

With a continuous mounting ring 56, the dome flange 52 comprises a plurality of tabs 82 circumferentially spaced so that adjacent ones form a gap therebetween, as shown in FIG. 5. Similarly, the aft radial flange 60 of the mounting ring 56 comprises a plurality of tabs 84 circumferentially spaced so that adjacent ones form a gap therebetween, as shown in FIG. 6. Preferably, but not necessarily, each of the two flanges 52 and 60 has an equal number of tabs. The dome flange gaps are wide enough so that the aft radial flange tabs 84 can pass through, and the aft radial flange gaps are wide enough so that the dome flange tabs 82 can pass through. Thus, to assemble the joint 30, the aft radial flange tabs 84 are aligned with, and axially slid through, the dome flange gaps. Then, the mounting ring 56 is rotated so that the aft radial flange tabs 84 are circumferentially aligned with the dome flange tabs 82. This provides a breech-lock engagement that produces axial retention between the dome plate 28 and the outer liner 16. Alternatively, the forward radial flange 58 could be provided with intermittent tabs instead of the aft radial flange 60.

Figure 2:
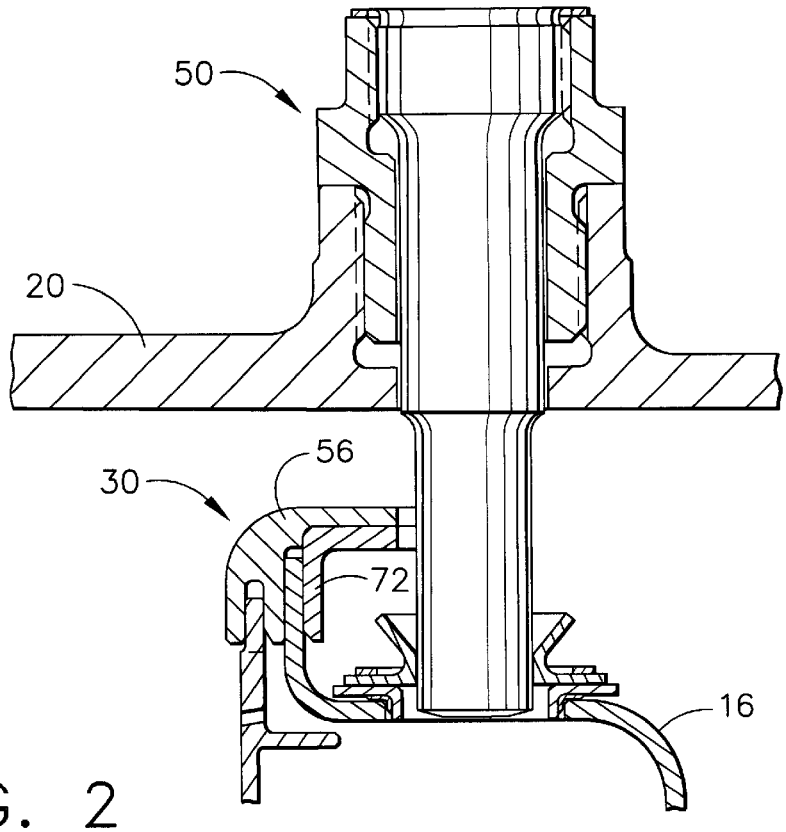
FIG. 2 is an enlarged view of the combustor of FIG. 1 showing an igniter.

As seen in FIG. 2, the mounting ring 56 and the retainer 72 are scalloped to accommodate the igniter 50. This does not significantly affect the mechanical integrity of either the mounting ring 56 or the retainer 72 because of the small number of igniters that are disposed around the circumference of the combustor 10. Most combustors typically have two igniters.

Referring again to FIG. 3, it is seen that an annular, axial-extending lip 86 is formed on the aft side of the dome plate 28, adjacent to the outer liner 16. The lip 86 and the outer liner 16 form an annular cooling slot 88 therebetween. A plurality of cooling holes 90 (only one shown in FIG. 3) is provided in the dome plate 28. The cooling holes 90 are arranged in a circle about the dome plate 28 and extend axially therethrough. The cooling holes 90 are radially located so as to supply cooling air to the cooling slot 88. The cooling slot 88 is oriented in a substantially axial direction so that cooling air is directed downstream and forms a thin cooling film on the inner surface of the outer liner 16.

The foregoing has described a dome-to-liner joint that has little or no structure forward of the dome plate and is relatively easy to assemble. The joint accommodates segmented dome plates by providing dimensional control of the segmented dome panels (i.e., maintaining the panels in a single plane). The joint has a streamlined external surface to enhance cooling air flow passage around the corner without using a cowl. This avoids the additional spatial requirements and weight penalty associated with a cowl.

While specific embodiments of the present invention have been described, it will be apparent to those skilled in the art that various modifications thereto can be made without departing from the spirit and scope of the invention as defined in the appended claims.

What is claimed is:

1. A joint for joining a dome plate to a combustor liner, said joint comprising:

a first flange formed on said dome plate;

a mounting ring having a groove formed therein, said first flange being disposed in said groove;

a second flange formed on said liner, said second flange engaging said mounting ring; and a retainer secured to said mounting ring and engaging said second flange.

2. The joint of claim 1 wherein said dome plate defines a forward surface, said joint being located primarily aft of said forward surface.

3. The joint of claim 2 wherein said first flange is offset aft of said forward surface.

4. The joint of claim 1 wherein said mounting ring has a rounded, upstream-facing corner.

5. The joint of claim 1 wherein said first and second flanges extend parallel to one another.

6. The joint of claim 5 wherein said retainer includes a retaining flange that extends parallel to said first and second flanges and engages said second flange.

7. The joint of claim 6 wherein said retainer includes a mounting flange that extends perpendicular to said retaining flange and is secured to said mounting ring.

8. The joint of claim 1 wherein said mounting ring includes a plurality of arcuate segments.

9. The joint of claim 8 wherein said retainer comprises a plurality of arcuate segments.

10. The joint of claim 9 wherein said retainer segments are circumferentially staggered with respect to said mounting ring segments.

11. The joint of claim 1 wherein said groove is defined by two flanges formed on said mounting ring.

12. The joint of claim 11 wherein at least one of said two mounting ring flanges comprises a plurality of circumferentially spaced tabs.

13. The joint of claim 12 wherein said first flange comprises a plurality of circumferentially spaced tabs.

14. A combustor comprising:

a dome plate having a first flange formed thereon;

at least one combustor liner having a second flange formed thereon;

a mounting ring having a groove formed therein, said first flange being disposed in said groove and said second flange engaging said mounting ring; and a retainer secured to said mounting ring and engaging said second flange.

15. The combustor of claim 14 wherein said dome plate defines a forward surface, said joint being located primarily aft of said forward surface.

16. The combustor of claim 15 wherein said first flange is offset aft of said forward surface.

17. The combustor of claim 15 wherein said dome plate is substantially flat.

18. The combustor of claim 17 further comprising at least one fuel injector located upstream of said dome plate, said at least one fuel injector being oriented parallel to and in close proximity with said dome plate.

19. The combustor of claim 14 further comprising a trapped vortex cavity.

20. The combustor of claim 14 wherein said mounting ring has a rounded, upstream-facing comer.

21. The combustor of claim 14 wherein said first and second flanges extend parallel to one another.

22. The combustor of claim 21 wherein said retainer includes a retaining flange that extends parallel to said first and second flanges and engages said second flange.

23. The combustor of claim 22 wherein said retainer includes a mounting flange that extends perpendicular to said retaining flange and is secured to said mounting ring.

24. The combustor of claim 14 wherein said mounting ring includes a plurality of arcuate segments.

25. The combustor of claim 24 wherein said retainer comprises a plurality of arcuate segments.

26. The combustor of claim 25 wherein said retainer segments are circumferentially staggered with respect to said mounting ring segments.

27. The combustor of claim 14 wherein said groove is defined by two flanges formed on said mounting ring.

28. The combustor of claim 27 wherein at least one of said two mounting ring flanges comprises a plurality of circumferentially spaced tabs.

29. The combustor of claim 28 wherein said first flange comprises a plurality of circumferentially spaced tabs.

* * * * *